US006056361A

United States Patent [19]

Cvek

[11] Patent Number: 6,056,361

[45] Date of Patent: May 2, 2000

[54] ARTICULATED SUPPORT CHAIR

[76] Inventor: Sava Cvek, 763 Massachusetts Ave., Cambridge, Mass. 02139

[21] Appl. No.: 08/583,807

[22] Filed: Jan. 5, 1996

Related U.S. Application Data

[63] Continuation of application No. 08/402,160, Mar. 9, 1995, abandoned, which is a continuation of application No. 08/071,231, Jun. 2, 1993, abandoned.

[51] Int. Cl.[7] ..... A47C 3/00

[52] U.S. Cl. ..... 297/300.2; 297/173; 297/239; 297/296; 297/446.2; 297/448.2

[58] Field of Search ..... 297/249, 162, 297/217.3, 217.6, 301.1, 354.11, 296, 284.4, 239, 446.2, 446.1, 449.1, 448.1, 448.2, 301.3, 302.3, 302.1, 300.1, 300.4, 294, 295, 173

[56] References Cited

U.S. PATENT DOCUMENTS

| | | | |
|---|---|---|---|
| 123,131 | 1/1872 | Taylor . | |
| 233,140 | 10/1880 | Candrian . | |
| 2,264,491 | 12/1941 | Ward . | |
| 2,558,171 | 6/1951 | Chesley . | |
| 3,467,432 | 9/1969 | Sullivan . | |
| 4,157,203 | 6/1979 | Ambasz | 297/354.11 |
| 4,216,994 | 8/1980 | Benoit . | |
| 4,709,962 | 12/1987 | Steinmann | 297/320 |
| 4,761,033 | 8/1988 | Lanuzzi et al. | 297/320 |
| 4,834,453 | 5/1989 | Makiol | 297/354.11 |
| 4,880,272 | 11/1989 | Brauning . | |
| 5,249,839 | 10/1993 | Faiks et al. . | |
| 5,318,340 | 6/1994 | Henry . | |
| 5,338,094 | 8/1994 | Perry . | |
| 5,383,712 | 1/1995 | Perry . | |
| 5,501,507 | 3/1996 | Hummitzsch . | |

FOREIGN PATENT DOCUMENTS

| | | | |
|---|---|---|---|
| 123984 | 3/1949 | Netherlands | 297/296 |

*Primary Examiner*—Milton Nelson, Jr.
*Attorney, Agent, or Firm*—Lahive & Cockfield, LLP

[57] ABSTRACT

An articulated support chair has a frame, a seat cantilevered from the frame, and a back hanging from the frame, with a lower end of the back hinged to an underside of the seat. A lumbar support extends from the seat and pivots to maintain supporting contact as the angles of the seat and back change under varying load conditions. In further embodiments, arm rests may be rigidly coupled below the seat to the back, and a fold-down tablet may be affixed to the frame at one side of the seat. Wedge units assemble in a modular fashion to define straight or different curved or bent rows for waiting room, conference room, or auditorium/theater installations and provide side tables, lockable cabinets, or utility and light bays between adjacent seats. A task chair, a side chair, and tandem chair embodiments are described.

19 Claims, 20 Drawing Sheets

ARTICULATED SUPPORT CHAIR

This application is a continuation of application Ser. No. 08/402,160 filed on Mar. 9, 1995, (now abandoned) Entitled: Articulated Support Chair which is a continuation of application Ser. No. 08/071,231 filed on Jun. 2, 1993 (now abandoned), Entitled: ARTICULATED SUPPORT CHAIR.

BACKGROUND

The present invention relates to chairs, and in particular to chairs that are fabricated, at least in part, with a support frame and a seat supported by the frame. In particular, it relates to such chairs that have a seat and a back, and are shaped or configured to provide a degree of back support, particularly lumbar or lower back support.

Among prior art chairs of this type are ones in which a separate, generally oval-shaped, padded back is movably mounted on a vertically extending metal strip or bracket attached to the seat, as well as constructions wherein various adjustment knobs vary the position or degree of pressure of one or more support elements located within a cushioned chair back. In one common but very basic construction, a fiberglass, wood laminate or similar thin shell formed in a pouch-like curve forms both the seat and back of a chair, and yields resiliently to some extent as a person sitting on the seat leans toward the back or side, providing conforming support.

In general, however, chairs with effective lumbar support are not available for simple work or meeting environments, and chairs configured for extra back support do not adapt well to the range of shifting, turning or leaning normally exercised by a person seated in a work environment—e.g., for the motions involved in typing, turning to a telephone, and leaning back to relax or forward to write. Moreover, designs which provide effective support tend to be bulky or complex, and do not lend themselves well to stacking or close spacing in ranks.

Accordingly, a simple effective chair construction that provides back support and overcomes one or more of these deficiencies would be highly desirable.

SUMMARY OF THE INVENTION

This is attained in accordance with a basic embodiment of the invention by a chair that includes a metal frame, a seat attached to the frame, and a back that is hinged to a hinge point on the underside of the seat and rests on the frame, such that backward pressure on the back applies upward pressure to the seat at the hinge point. A lumbar support plate attached near the rear of the seat moves to follow the lower back as the seat moves.

In one embodiment, the upper portion of the chair back is suspended in a hanging joint from a rear portion of the frame with a rocking pivot which allows the frame and chair back to each move back and forth as well as to rock side to side out of alignment. The lumbar support is attached to a different portion of the frame, near the rear of the seat. The seat itself rigidifies the frame, so that motion of the lumbar support is closely coupled with flexing of the seat. Alternatively, the lumbar support may attach directly via special brackets, to a rear portion of the seat. As weight shifts to the back, pressure at the hinge raises the rear of the seat,and the lumbar support shifts both upward and forward.

In one embodiment as a stackable chair, one set of feet has castors, so that when placed in a stack, the stack of chairs may be tilted and conveniently rolled.

In another embodiment adapted for tandem or multiple seating, the frame elements, rather than including legs for directly resting on the floor, include a bracket for resting on a cross-bar or beam. In this embodiment, plural chairs may mount next to each other on a single cross-bar. In a further aspect of this embodiment a spacer wedge fills the space between adjacent chairs, and each wedge constitutes a side table which may further include a lockable cabinet. Affixed to each chair is a tablet or writing board that pivots or rotates to a horizontal position extending entirely across the front of the chair. The wedges may be straight or right-angled, or may consist of an angular sector, the taper of which defines or corresponds to the curvature of a curved rank of seats. The construction is thereby adapted for waiting room, terminal, classroom or theater seating.

In another embodiment as a task chair, the frame is supported in a movable base and the seat is cantilevered back from a front edge of the frame.

In one preferred aspect of the lumbar support element, a frame or bracket holds a support pad made of a cushioning material, such as a self-skin urethane foam, and a spring strip is embedded in the support pad. A bolt extends between ends of the strip, bowing it forward, and an adjustment knob tightens or loosens to set the bow curvature. Each embodiment may have either high- or low- back, this element being essentially decoupled from the lumbar pad, so that it is possible to have a high-backed chair that enhances upper back support and lumbar support simultaneously.

BRIEF DESCRIPTION OF THE DRAWINGS

These and other desirable features of the invention will be understood from the description of illustrative embodiments to follow, taken together with the drawings, wherein.

DETAILED DESCRIPTION OF THE INVENTION

Figure 1:
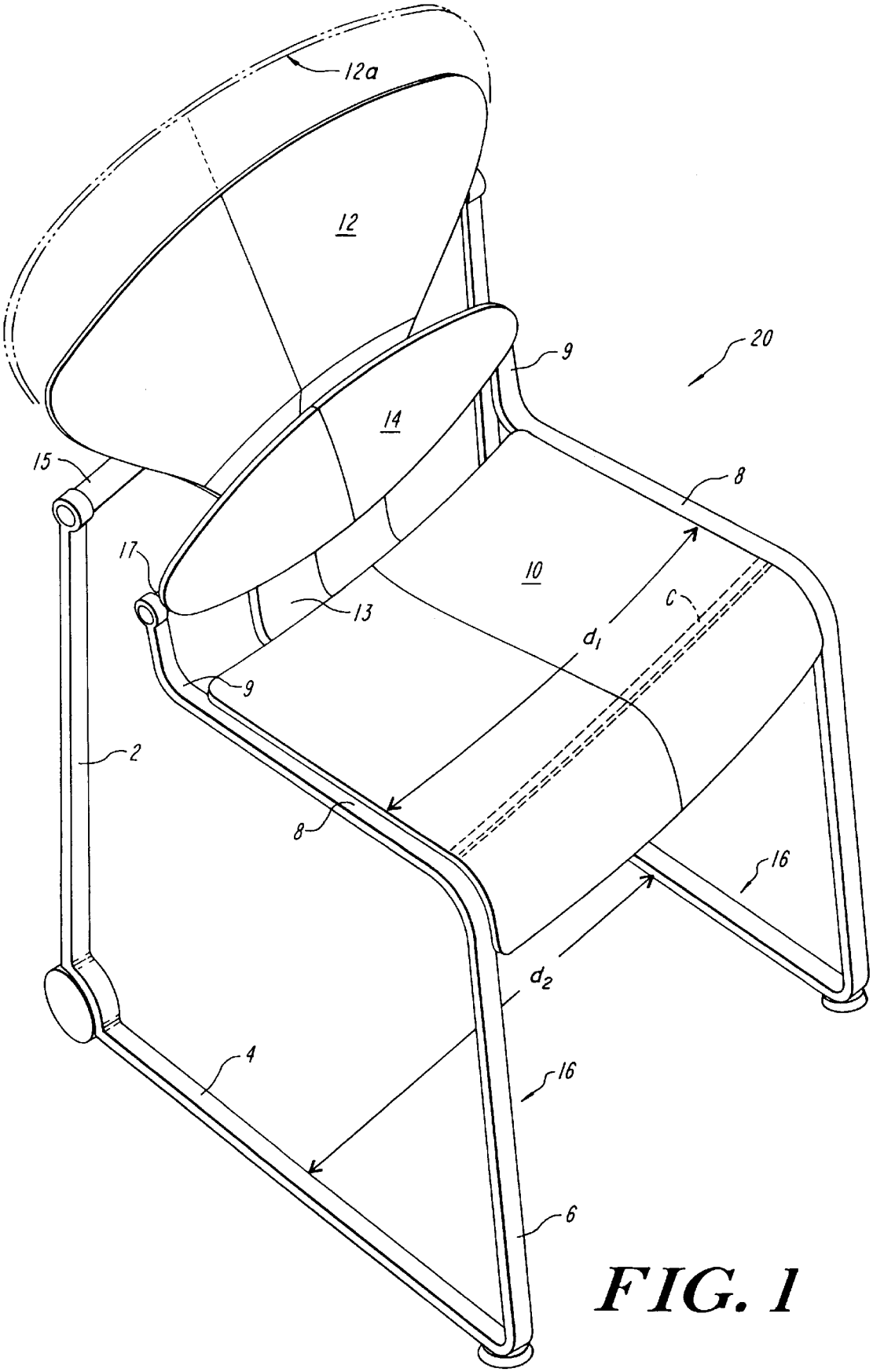
FIGS. 1–5 are views of a side chair in accordance with a first embodiment of the invention.

FIG. 1 illustrates a basic embodiment of a side chair 20 according to the present invention, wherein a frame 16 carries three body-supporting shell-like elements, namely a seat 10, a back support 12 and a lumbar support 14. Back 12 may be low, as shown, or high as indicated by phantom lines 12*a*. While not specifically visible in FIG. 1, preferably the front legs are spaced closer to each other than are the back legs, and the width $d_1$ at the top across the seat is less than the side-to-side width $d_2$ between the feet. This allows the chairs to readily stack.

In the illustrated embodiment, the frame 16 consists of symmetrical left and right side tubular halves, each including a rear support leg 2, a base 4, a front leg 6, a seat support bar 8, and a lumbar support mounting arm 9, the first four portions being bent around in a roughly trapezoidal contour to provide a spring-like top and rear supports. That is, each corner or bend of the frame acts as a spring joint, so that the adjacent section may flex under load-bearing forces. The seat 10 is mounted between the support bars 8, and rigidities the frame, which nonetheless may also have cross pieces ("C" shown in phantom) under the seat for additional strength, rigidity or alignment purposes.

The seat back 12 is mounted, via an integral extension 13 or a supporting bracket arm, to the seat bottom, and rests at its top end on a cross-piece 15, which yieldably flexes as the rear support legs 2 bend backward. The lumbar support 14, on the other hand, is not connected to the seat bottom, but rather mounts directly on the support mounting arms 9 for its sole support. Arms 9 extend in a continuous band from the seat support bars 8 of the frame, and are relatively short, placing the support 14 squarely in the lumbar region and coupling its motion fairly tightly to that of the rear region of the seat.

Figure 2:
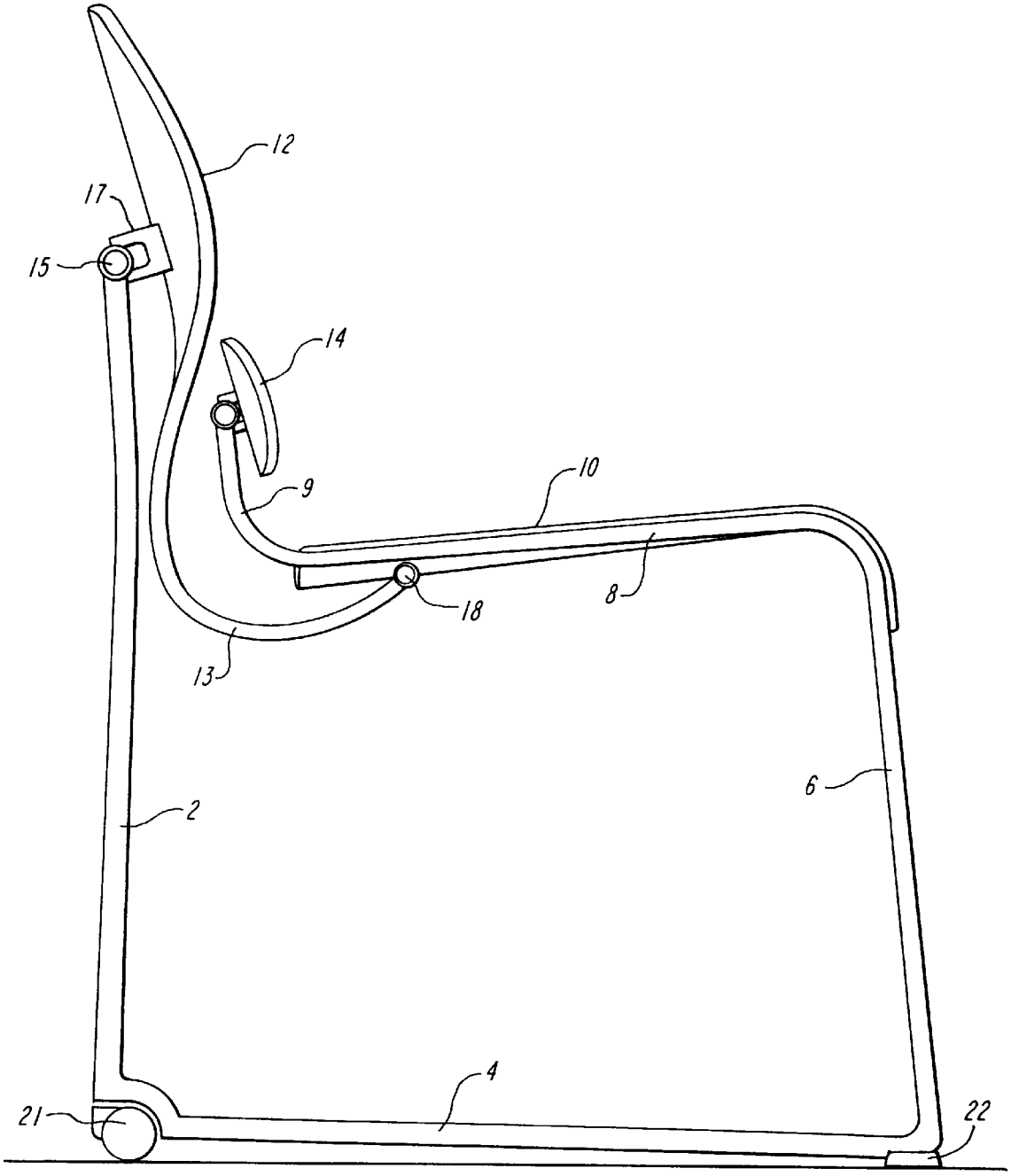

As more clearly seen in the side view, FIG. 2, back 12 is affixed to a supporting U-block 17 that fits over the cross bar 15 so that the block essentially hangs from the bar but is free to rotate its angular position. The bottom portion 13 of the back loops in a wide arc shaped like a deeply curved bow, behind and below the rear of the seat, bending upward to hinge on a hinge pin 18*a* of hinge 18 (FIG. 3), with the pin 18*a* located on the underside of seat 10 slightly inward from its back edge. Thus the back 12, 13 may be seen as a curved articulation arm extending between two parallel joints defined by the bar 15 and the hinge pin 18*a*, so that backward motion at the top of back 12 see-saws the curved back about bar 15 and results in upward motion of the seat at the hinge.

Also shown in FIG. 2 are a 360° ball castor 21 located at the rear foot, and a glide or floor protector 22 located at the front foot of the chain. The single castor 21 on each side elevates the base 4, so that it rides above the ground and the chair contacts the floor firmly only at the four feet 21, 22. The frame 16 is of light springy construction that can rack slightly, so all four contact points engage.

Figure 3:
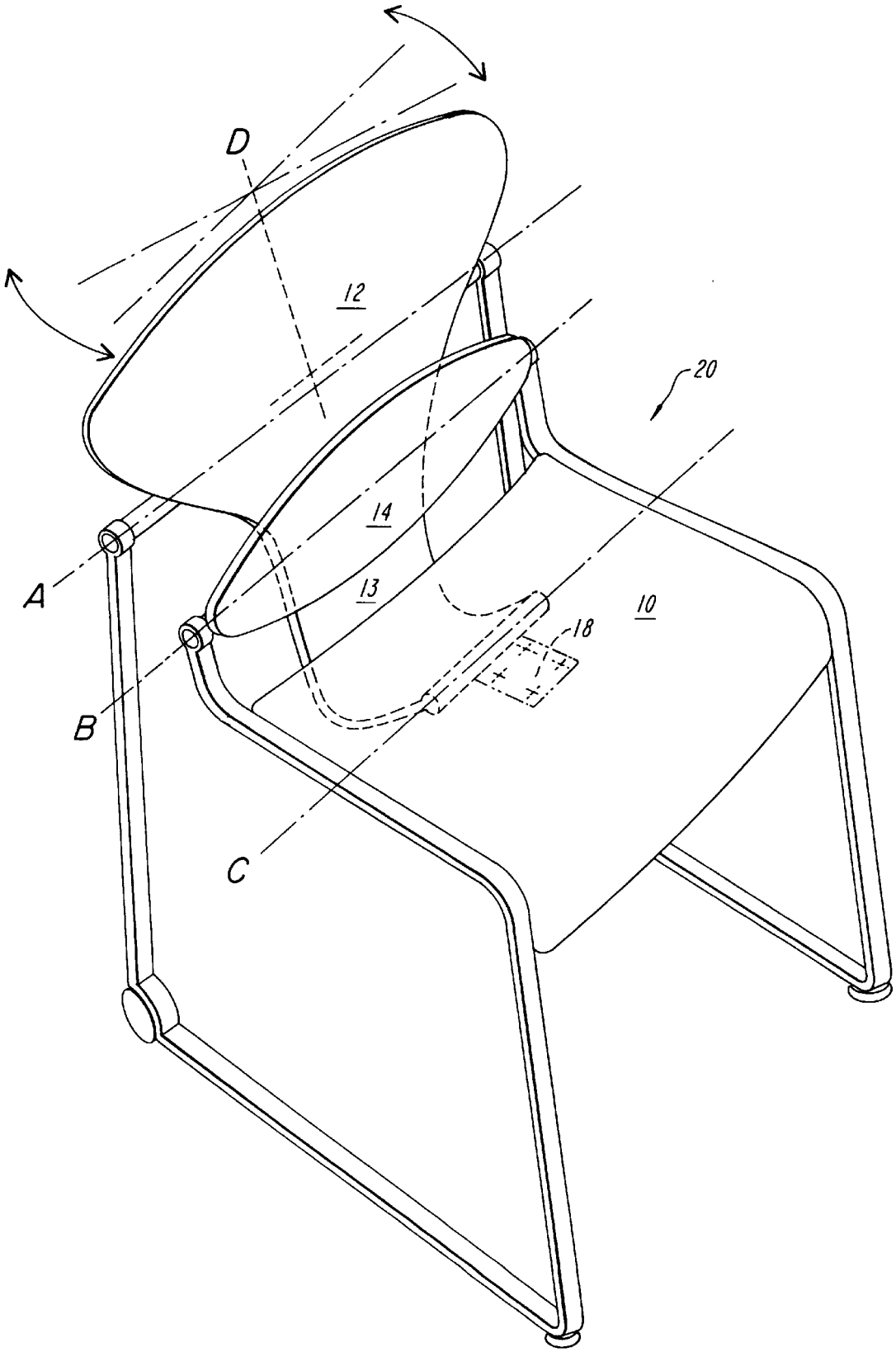
Figure 4:
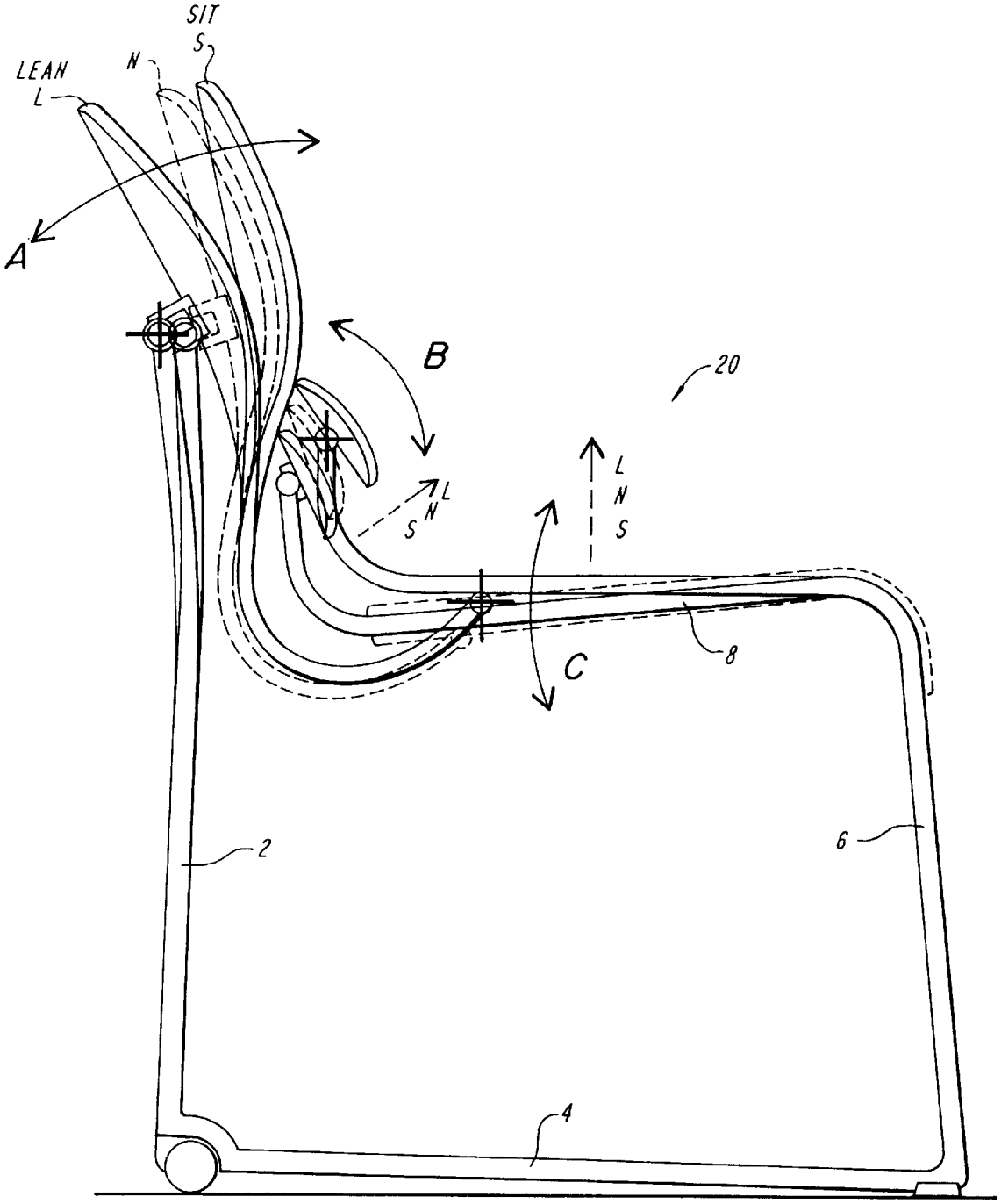

FIGS. 3 and 4 illustrate the articulated motion of the components of chair 20 as the seating load is redistributed. The seat, support 14 and back have three parallel pins, bars or joints defining rocking axes labeled A, B and C which are essentially parallel and horizontal. A fourth rocking axis D extends vertically through the block 17 at the center of the back, and allows the back to twist side-to-side.

FIG. 4 shows the configuration of the chair elements about the three articulation axes A, B, C in response to load. When normally seated, denoted N and indicated by a dashed line drawing, load is evenly distributed across the seat 10 which, due to its driving-board-like mounting with frame support 8, assumes a mid-position with the back 12 also in a middle position. If the user either leans forward, transferring weight to the front of the seat, or leans backward, putting pressure on the top of the back 12 (as happens, for example, when effecting a seated stretching yawn), the back shifts back while the seat shifts up, to the positions marked L. Finally, if one sits firmly at the back of the chair the seat shifts down, rocking the back forward at its top to provide support at the relatively vertically oriented position marked S. Thus up-to-down seat displacements are converted, as the seat moves hinge pin 18*a* diagonally downward to the rear, into back-to-front displacements of the upper back 12, and correspondingly pressure on the back causes the seat to stiffen or to change position. During movement of the seat and back, the lumbar support 14 tracks motion of the rear portion of the seat, but being pivotally suspended it lies flat against the user's back to follow the changing back angle as the seat-to-back distance shifts.

Figure 5:
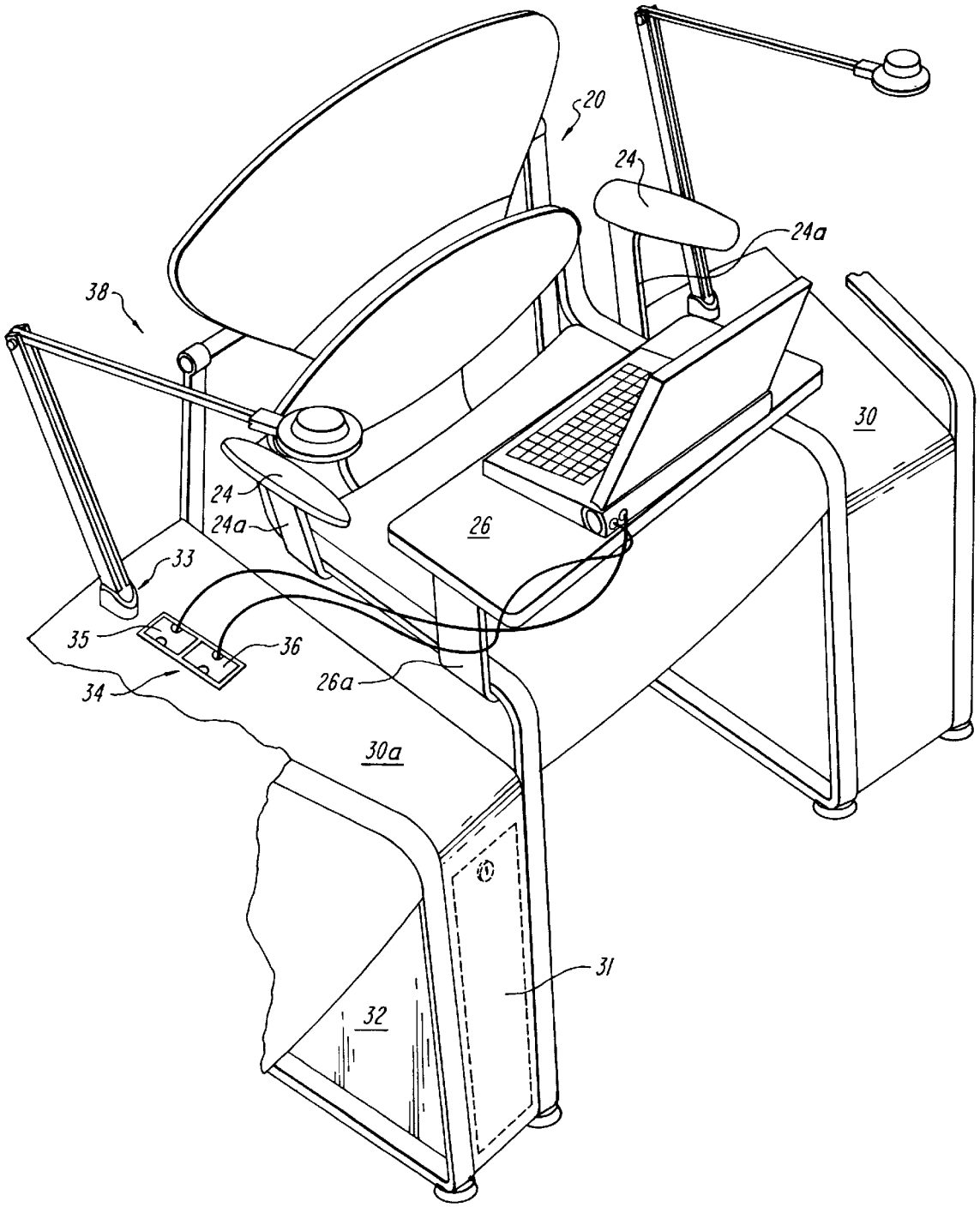

FIG. 5 illustrates further features of the chair of FIGS. 1–4 incorporated into a seating system 38. In this system, each chair 20 is connected to an adjacent chair by a wedge unit 30, which is a truncated wedge-shaped spacer that fastens to the legs 2, 6, and provides a table surface adjacent to each chair. Wedge 30 may consist essentially of one or more rigid cover plates with suitable fasteners, or may constitute a closed cabinet as shown at 30*a*, with a locking door 31 and side walls 32. Preferably each wedge unit 30, 30*a* has a lighting dock 33, in which a lamp fits and connects to a power outlet. Also shown is a utilities bay 34 containing a first utility socket module 35 for telecommunications connection for a phone, fax or modem, and a second utility socket module 36 for electrically driving a powered device. Socket module 36 is preferably a low-power module with selectable voltage level for the standard common operating power requirements of laptop computers and the like. Such socket modules 35, 36 and utility bays 34 are described in greater detail in applicant's co-pending U.S. patent application Ser. No. 08/028,410, filed Mar. 9, 1993, entitled Network Table. That patent application is hereby incorporated herein by reference, particularly for its extensive discussion of utility modules and their incorporation into table or work surfaces.

Turning now more specifically to the chair 20 shown in FIG. 5, it contains in addition to the features noted in FIGS. 1–4 a pair of arms 24 supported by bars 24*a*, and a broad flat tablet 26 which is supported at one end by an articulated joint support 26*a*. Tablet 26 extends entirely across the width of the chair, unlike that of a typical school or auditorium chair to which it is in some respects similar, and has ample width for supporting both a computer or a fax machine, and work papers, at once.

Figure 18A:
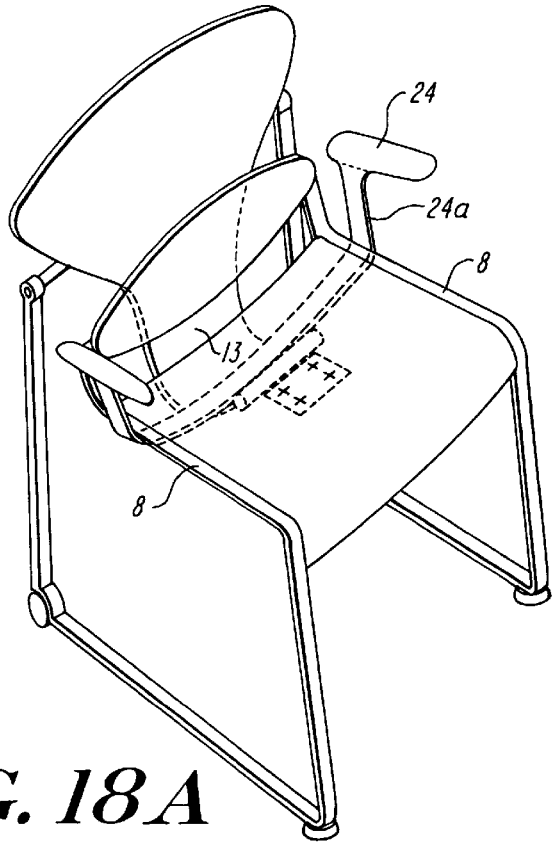
FIGS. 18A–18B illustrate details of a further embodiment based on that of FIG. 1.
Figure 18B:
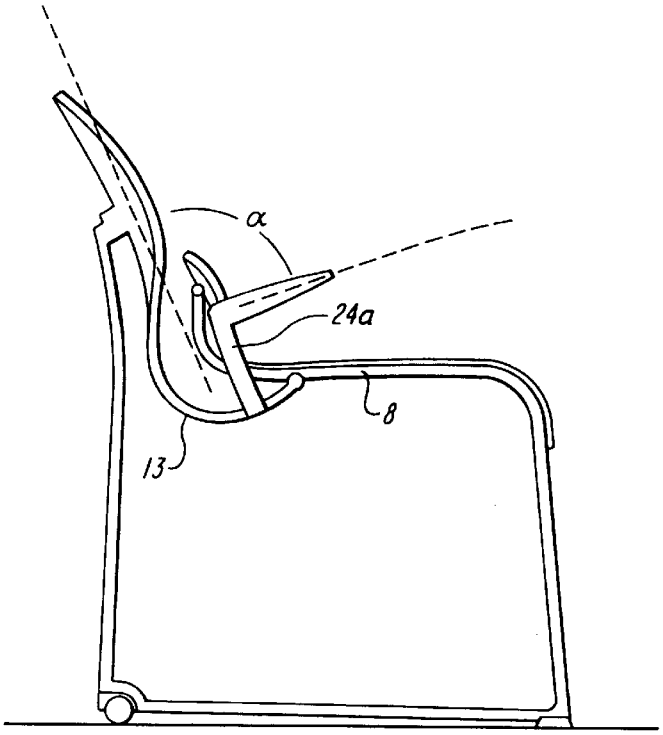

Details of preferred implementations of chair arms and of the tablet are shown in FIGS. 18A, 18B, 19A and 19B. As illustrated in FIGS. 18A, 18B the supports for arms 24*a* extend around the frame bars 8 and are rigidly fastened below the seat to the lower forward portion of the pivoting back shell 13. This preserves a substantially fixed set of distance, height and angular relationships between the armrests 24 and the back support, hence the user's shoulders, providing an angle of approximately $^{\pi}/_{4}$. between the arm rests and the back, although this angle may vary slightly with the distribution of body load due to the spring-like coupling of the arched back portion 13.

Figure 19A:
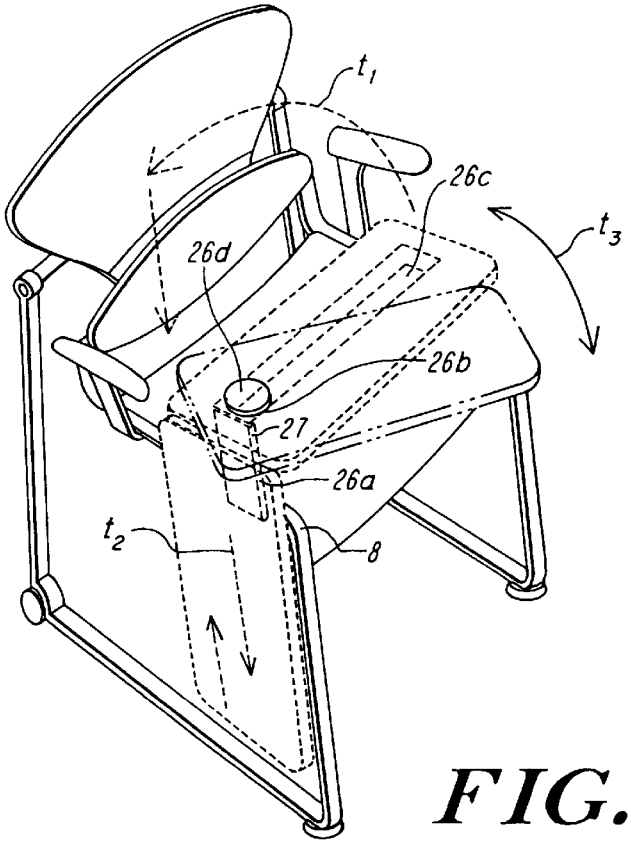
FIGS. 19A, 19B illustrate other details of the further embodiment based on that of FIG. 1.
Figure 19B:
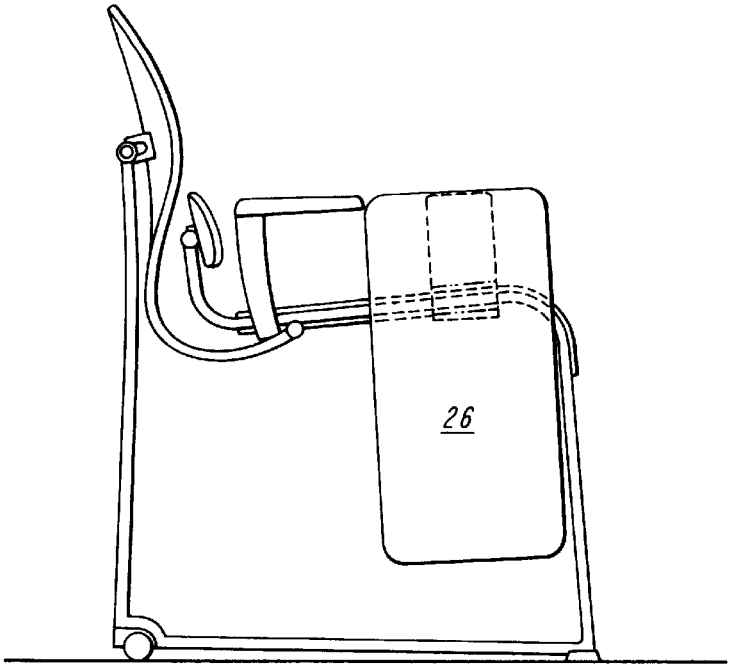

The tablet support 26*a*, illustrated in FIGS. 19A and 19B, is attached to frame bar 8 at the front on one side of the chair, and attaches to the tablet 26 by a hinged mounting 26*b* that has a T-headed button or bolt 26*d* slideably secured in the underside of the tablet. For example, an elongated slotted plate 26*c* mounted on the underside of the tablet may secure the tablet down on the T-bolt so it slides back and forth. The tablet pivots in a horizontal plane, when up, along the direction $t_3$ to allow comfortable positioning of the working surface at the front of the seat. To retract the tablet, it is rotated upwardly about hinge pin 27 along the direction $t_1$, and once the hinge 26*b* is in a straight vertical position, the tablet is dropped, by a straight sliding motion, along the direction $t_2$ so that it rests vertically, flush against the edge of the chair. The assembly may have a slight inclination, to angle inwardly an inch or so under the chair, so that it clears the top of the wedge 30, 30*a* (FIG. 5). With this hinge construction, no special offsets or cutouts are necessary in the adjacent cabinetry.

Figure 20:
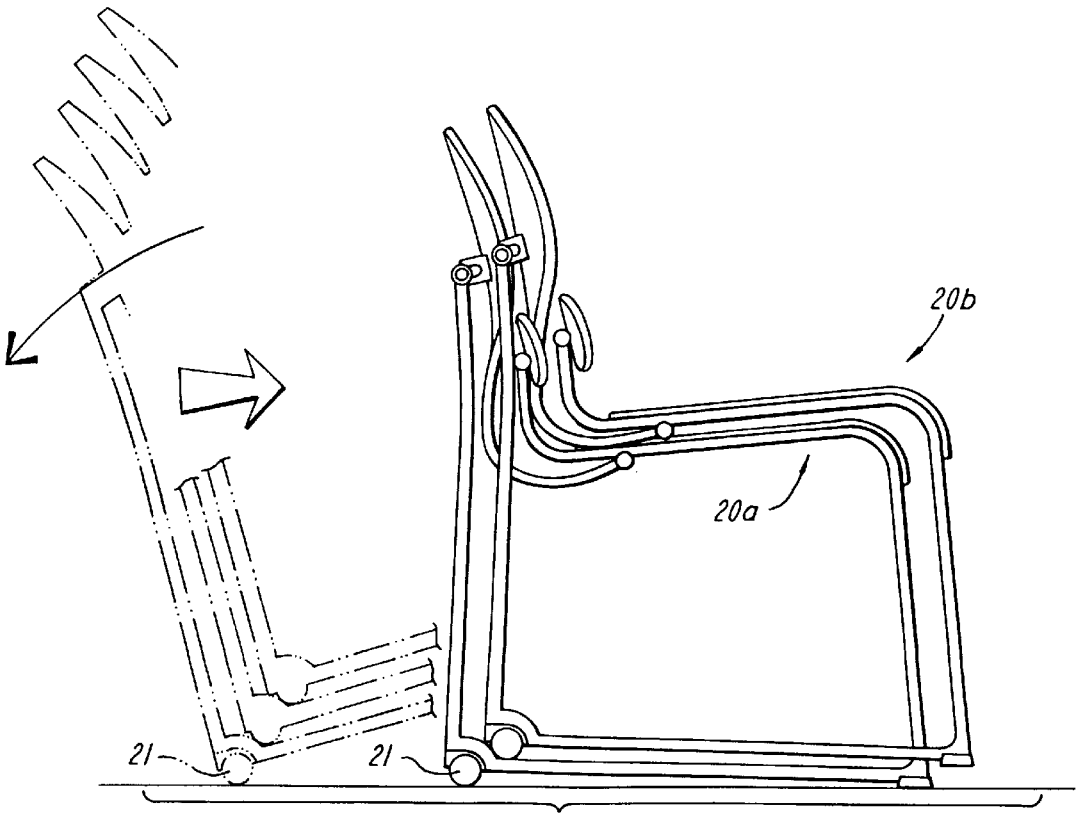
FIG. 20 illustrates stacking of chairs as shown in FIG. 1.

Returning now to a discussion of the basic chair skeleton, FIG. 20 illustrates chairs 20*a*, 20*b* as in FIG. 1 stacked for storage or transportation. In this position, only the bottom chair rests on the floor, and by tilting the stack backward, the entire stack is readily balanced, like a hand truck, and may be pushed forward or pulled backward on the single pair of castors 21 while maintaining a gentle backward or downward pressure on the chair back. Thus the chair entirely eliminates the need for chair racks or wheeled dollies which are conventionally used to move quantities of side chairs.

FIGS. 6–13 illustrate a second basic construction of an articulated support chair 60, as a task chair, a heavier piece of office furniture involving a rigid frame construction. In this construction a base 40 supports an upper frame assembly 50 on which the various body-contacting contoured sheet supporting components are mounted.

The base 40 is a multi-footed structure, preferably formed as a casting, with legs 41*a*, 41*b*, 41*c* . . . , of which there are preferably five, angling downward from a central post bore 42 to a corresponding plurality of feet 43*a*, 43*b*, 43*c* . . . that extend horizontally or at a shallow angle radially outward from the center and low to the floor, with a castor 21 at the tip of each foot. The post bore supports the frame 50, which sits atop a height-adjustment post 52, while frame 50 supports contoured seat 70, back 72 and lumbar support 74 (FIG. 8), as described further below. However, unlike the first embodiment described above, the upper frame is formed of rigid elements, and does not directly carry the lumbar support. The post 52 may be threadedly adjustable, as shown, or the post bore 42 may include a hydraulic piston assembly, as known in the art, to vary the height of the seat.

Figure 6:
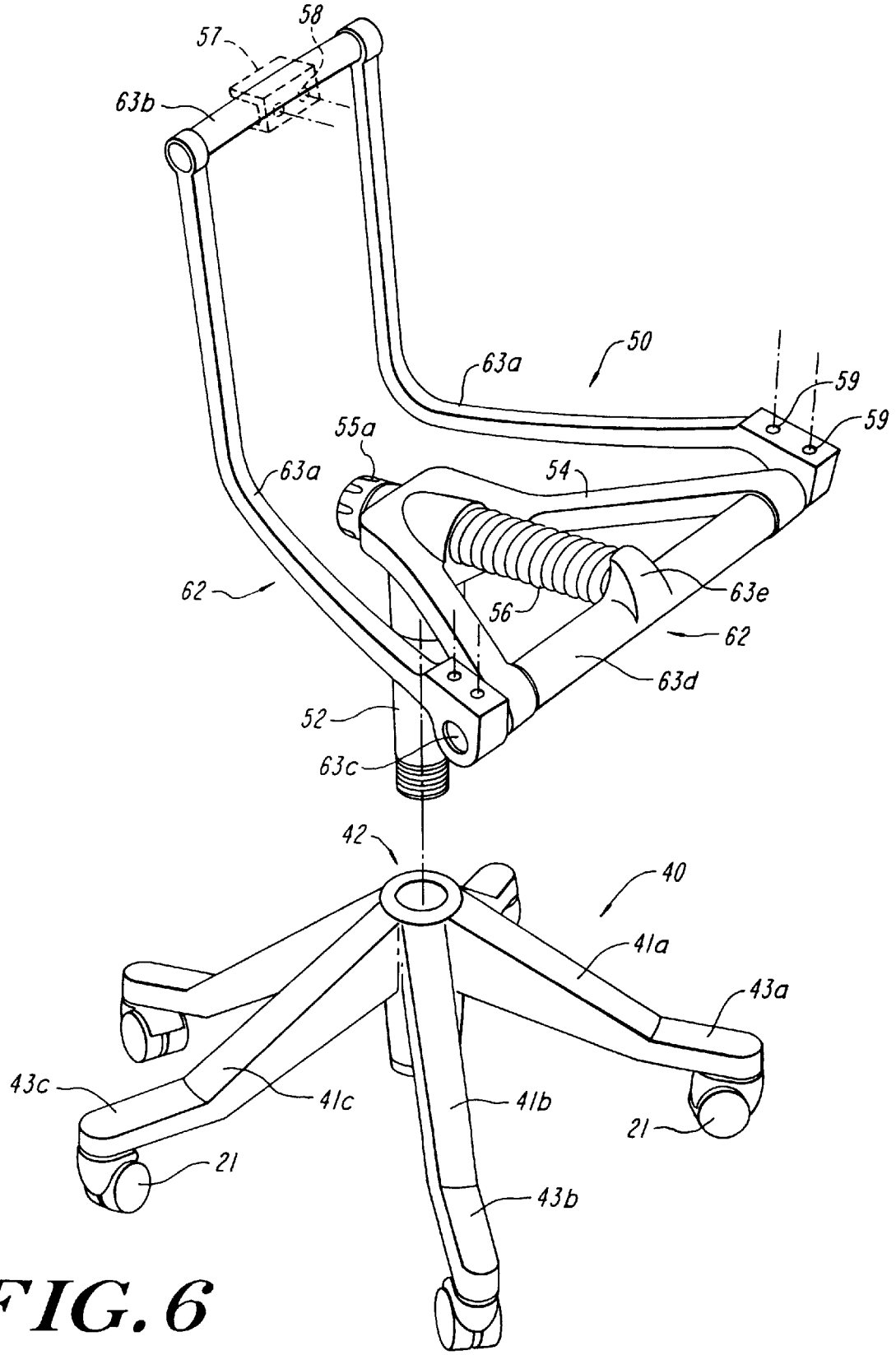
FIGS. 6–13 are views of a second illustrative embodiment of the invention as a task chair.
Figure 7:
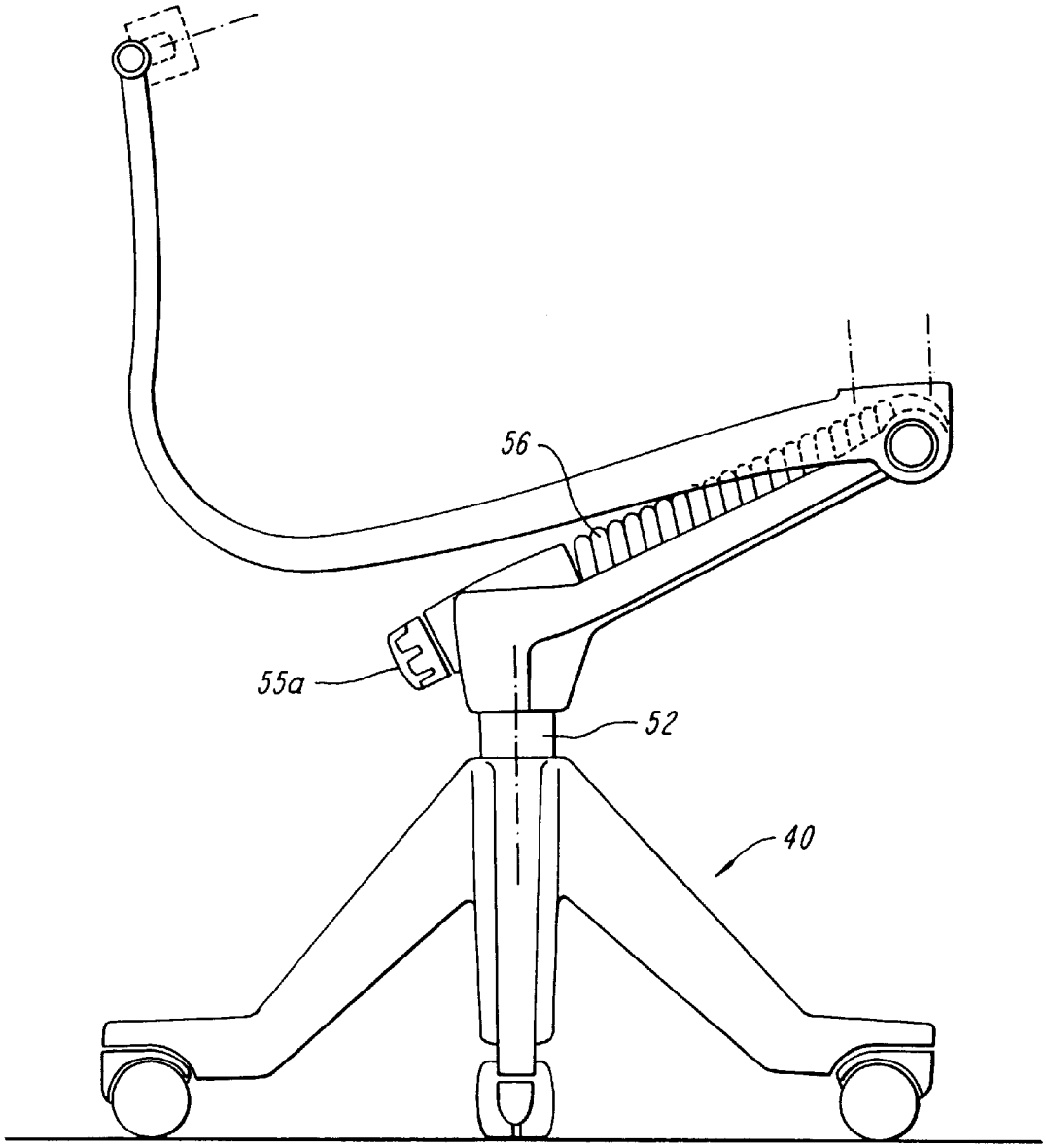

As shown in FIGS. 6 and 7, the upper frame includes two major assemblies, an inner assembly principally including post 52 and a wishbone 54 which are rigidly interconnected, and an outer assembly 62 made up of seat frame side pieces 63*a*, back cross bar 63*b*, front cross shaft 63*c* and thrust member 63*d*. The arms of wishbone 54 are journalled at their ends on front cross shaft 63*c* so that the outer frame is rotatably suspended at its front edge from the wishbone assembly. A thrust bolt with adjustment knob 55*a* extends within a spring 56 on the wishbone assembly to adjust the force of the spring 56 against a thrust pad 63*e* formed on the thrust member 63*d*. The frame members 63*a*, 63*c* and 63*d* are rigidly affixed to each other so that movement of the frame and vertically extending back part precisely tracks the slight angular adjustments of the thrust pad as the adjustment bolt and spring are tightened against the member 63*d*. Thus these supporting members rotationally hang from shaft 63*c*, as the adjustment knob sets the overall seat declination.

Figure 8:
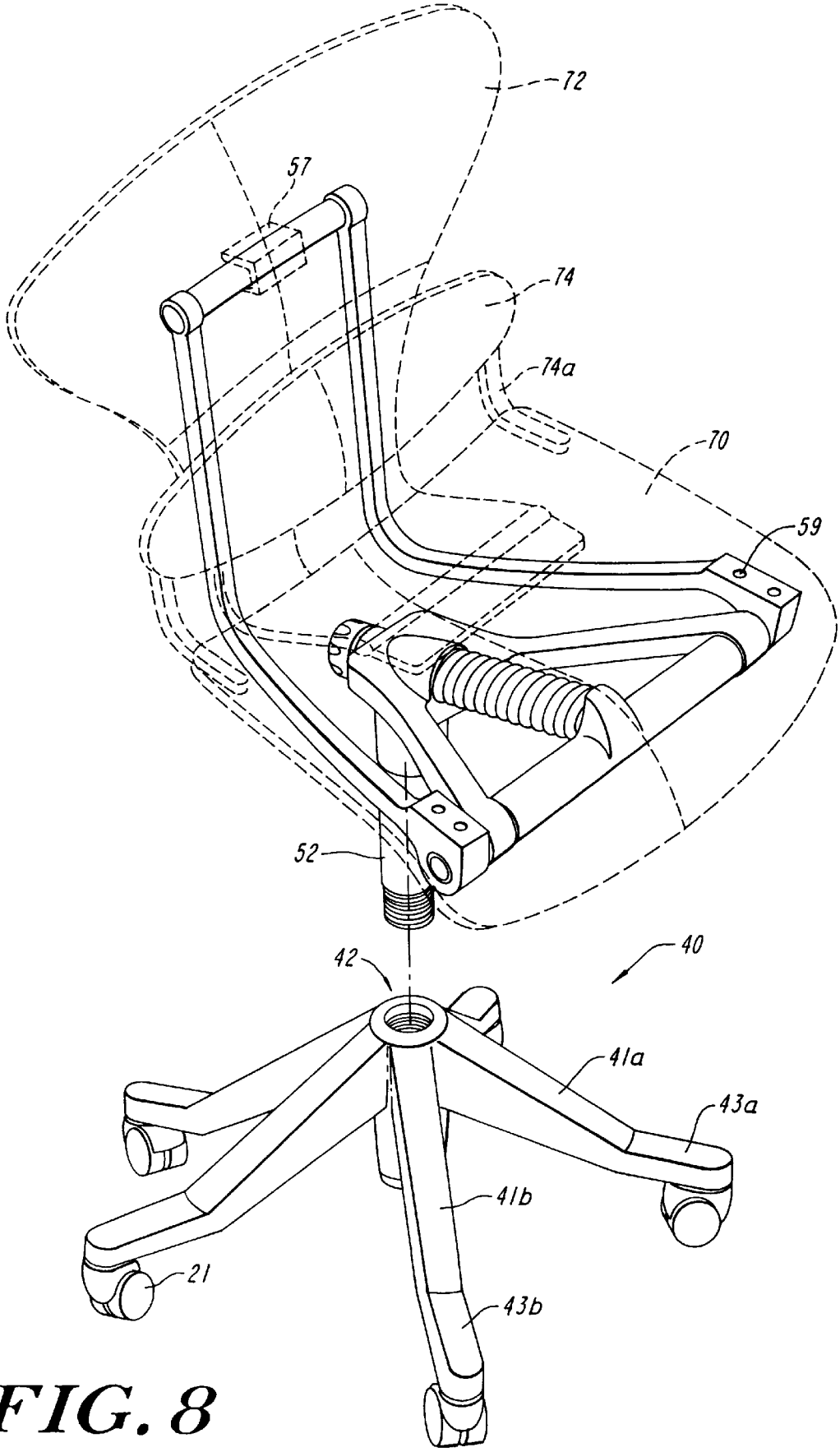

As best seen in FIG. 8, the seat 70 attaches via mounting holes 59 at the front of each side piece, on aligned flats at each side, so that the seat 70 is cantilevered back from its mounting points like a diving board. Thus the seat itself provides the displaceable spring flexibility which in the embodiment of FIGS. 1–5 is provided largely by the springy bent metal support frame.

Figure 9:
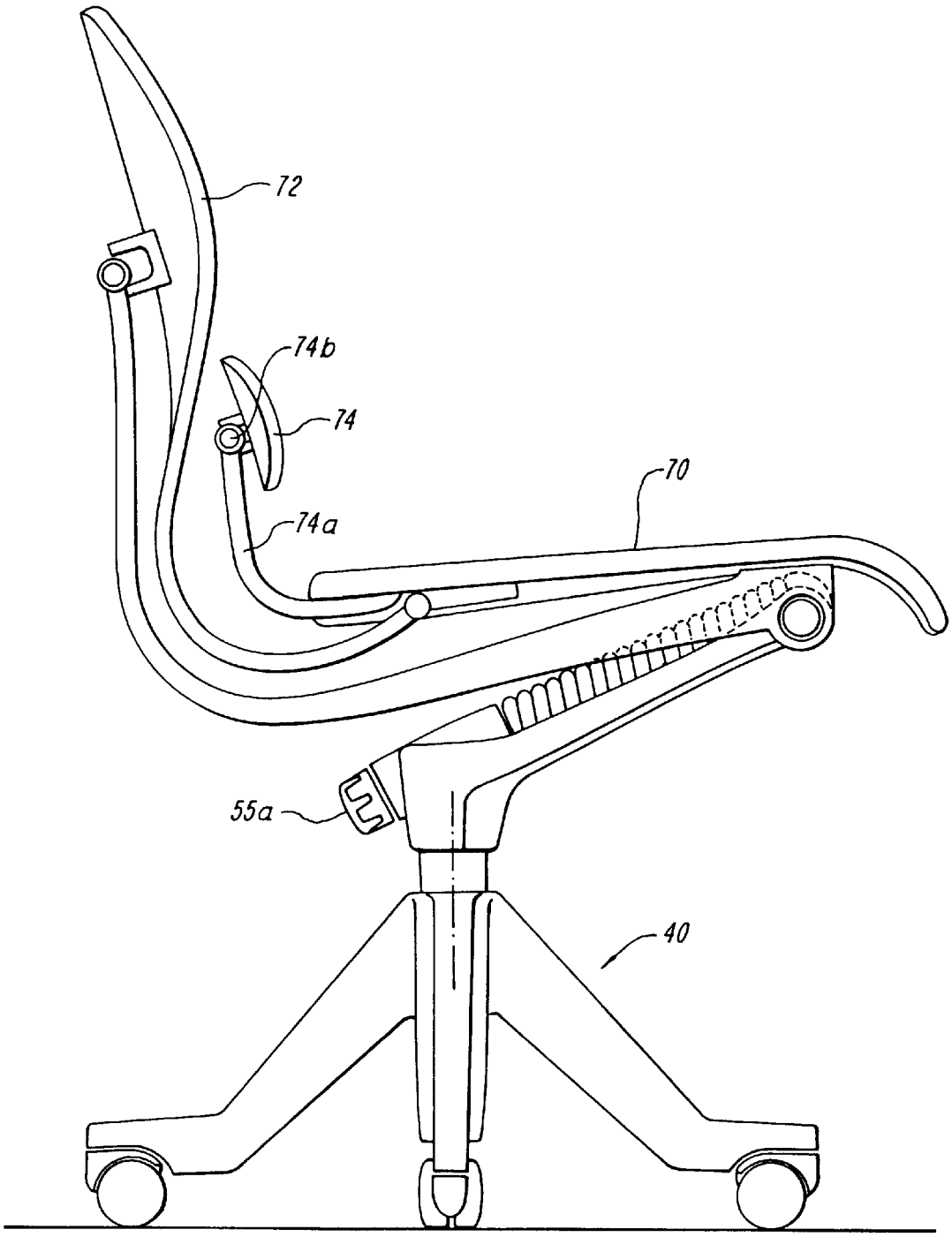
Figure 10:
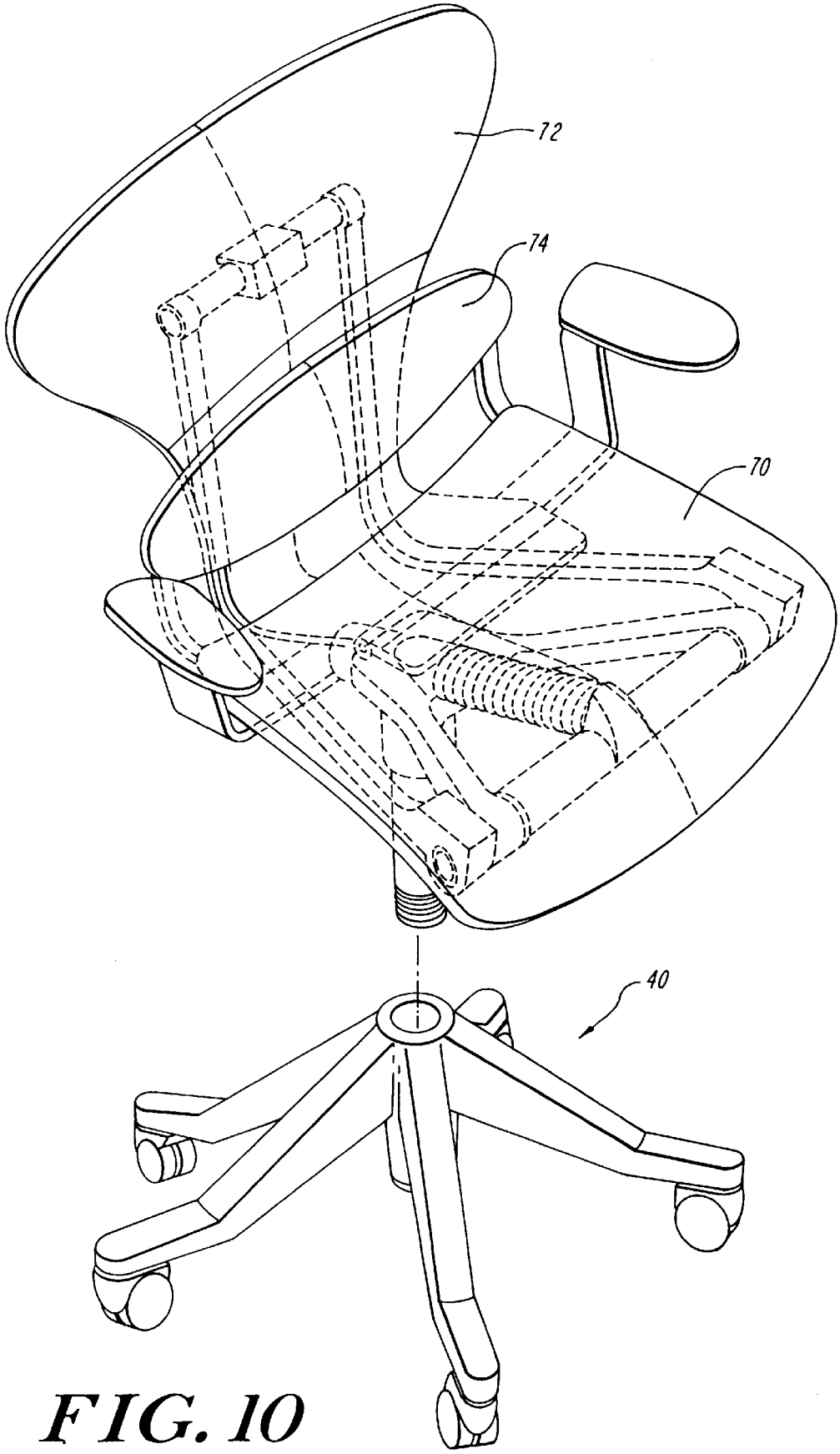

The back shell 72 attaches to a hanging pivot block 57, which may be identical to the bracket 17 of the first embodiment, by mounting holes 58, and at its lower end is hinged to the underside of the seat 70, as best seen in the side view FIG. 9. While the hanging upper support depends from the substantially rigid frame 62, the bottom hinge support lies on the downward flexing seat shell 70, and continuously operates to shift the upper back forward toward a vertical disposition as the seat lowers under load.

Figure 11A:
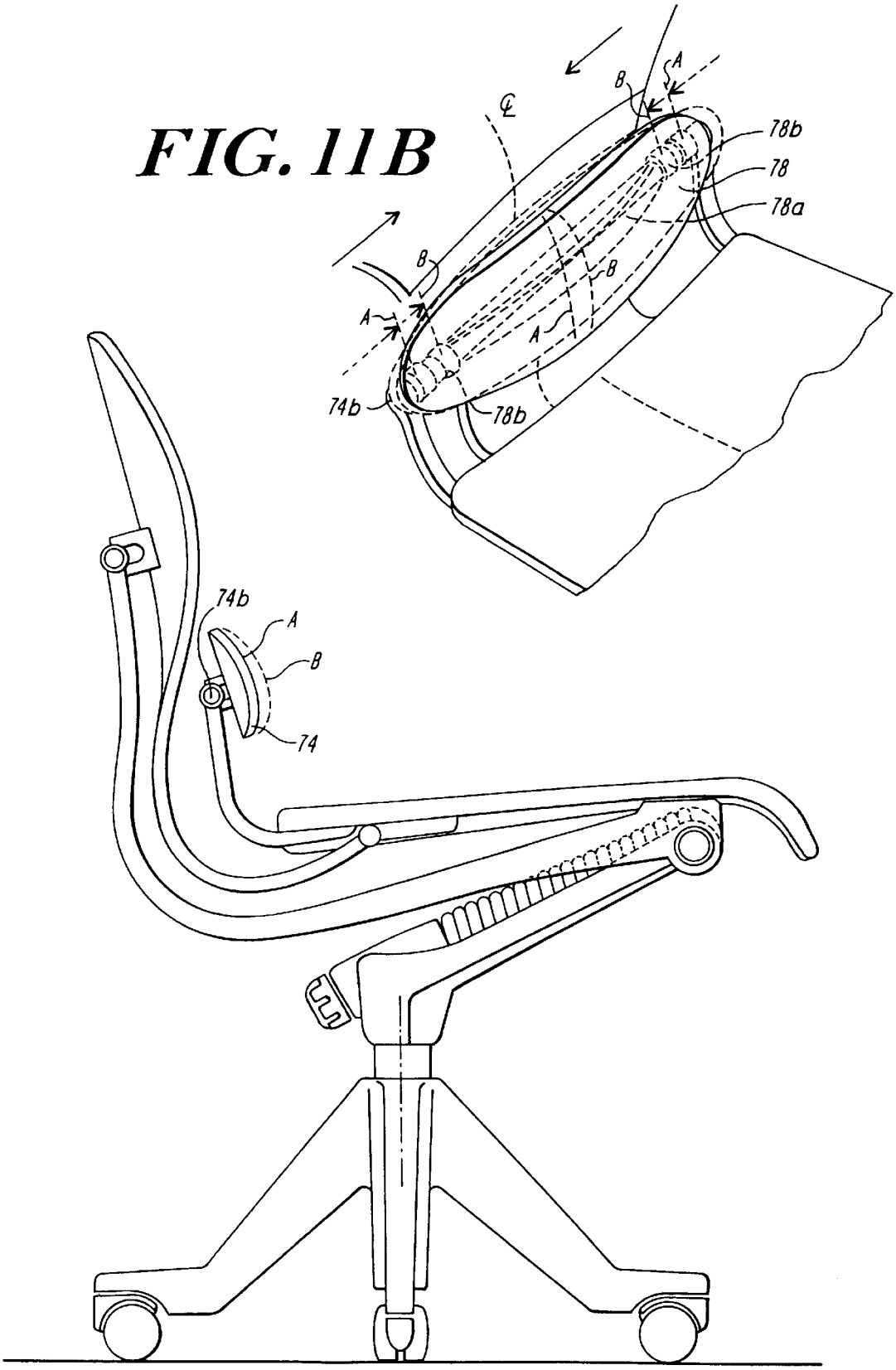

As best seen in FIGS. 8 and 9, the lumbar support 74 is supported on a cross-piece between two short stub arms 74*a* attached to the rear of the seat 70 at each side, and has a cushion that pivots about a bar or cross-piece 74*b* connecting the stubs, to follow the surface contour of the user's back. Preferably, the lumbar support 74 is convexly arched toward the front, so that it maintains firm contacting support in the lumbar region despite its relatively small range of motion with respect to the seat bottom. In a presently preferred embodiment this is achieved as shown in FIG. 11B, by providing a cushioning pad 78 which covers or encloses an inextensible but stiff and flexible strip 78*a* having a collar 78*b* attached to each end. The cross-piece 74*b* extends through the two collars 78*b* and is mounted with a cam or adjustment thread so that the collars can be moved closer or further apart to adjustably set the degree of arching of the strip 78*a*, hence the shape and firmness of cushion pad 78. Thus, as the collars 78*b* go from their maximum spacing at the position marked "A" in phantom, to a closer spacing marked "B", the cushion bows outwardly.

Figure 12:
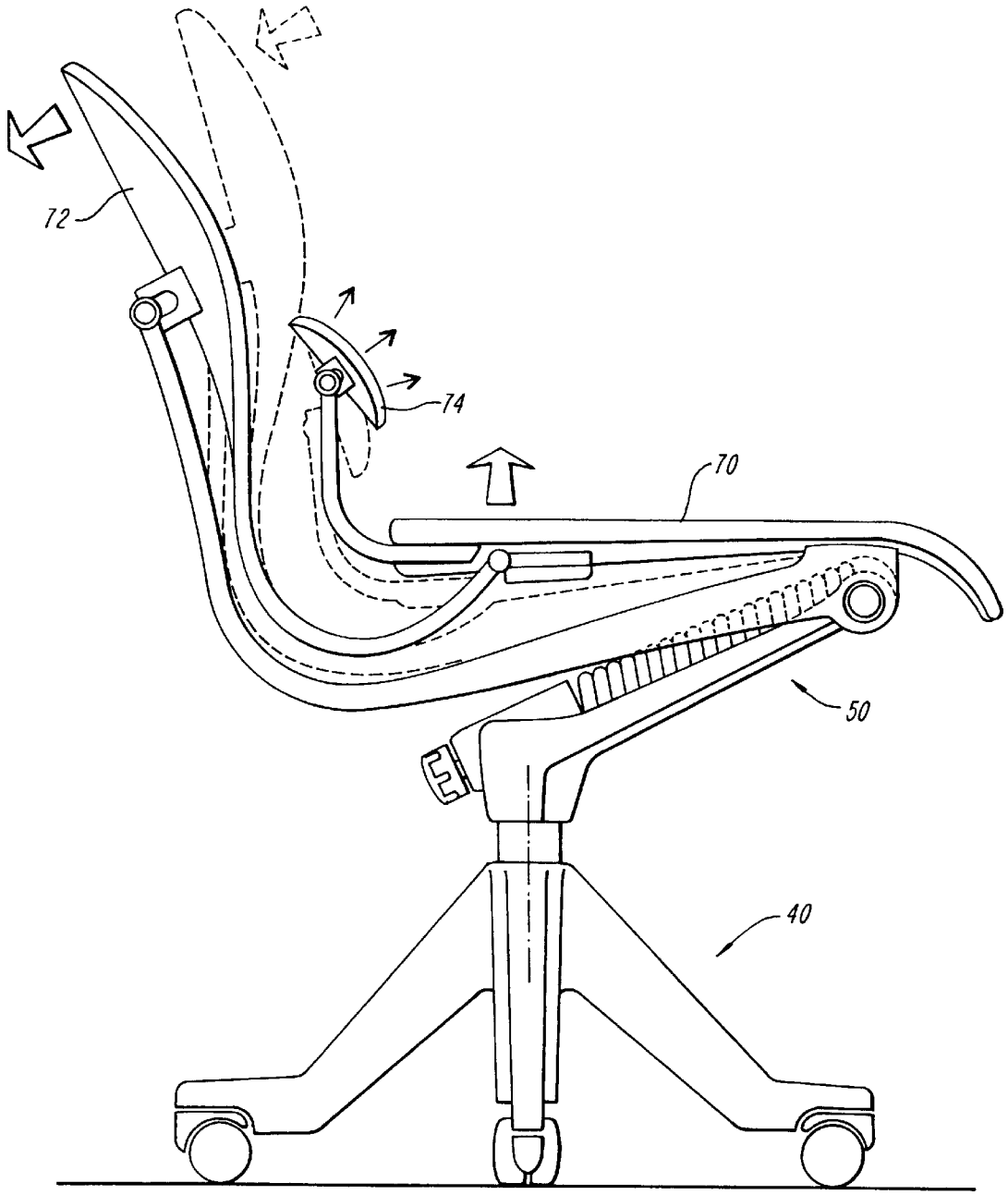
Figure 13:
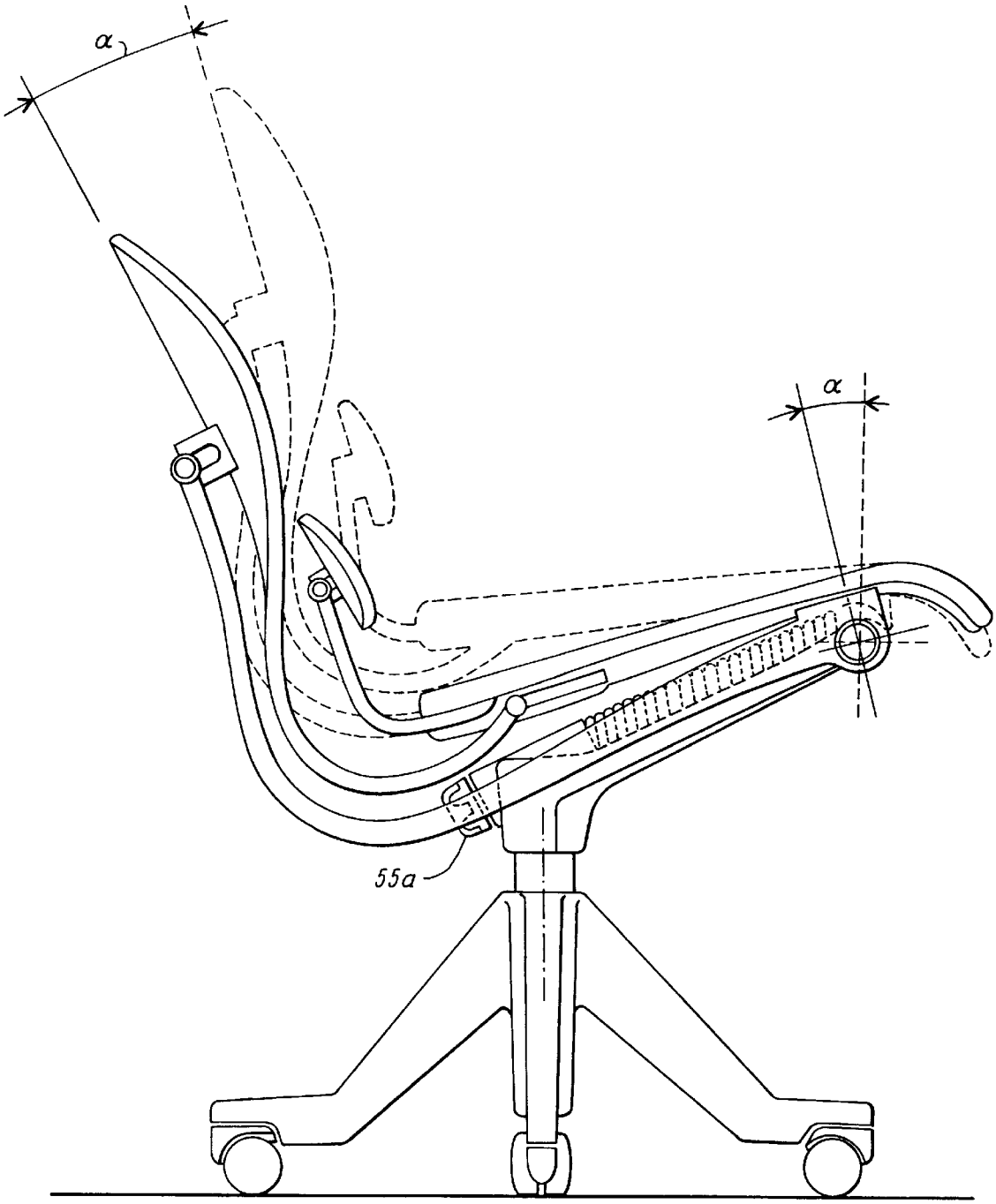

FIGS. 12 and 13 illustrate the setting of the nominal angular disposition at the seat and back (FIG. 13), and the effective motions of the three support shells 70, 72, 74 under motions induced by different seat and back loadings. The pendent bowed back 72 hinged to the underside of an unsupported seat 70, results in the same direction of response to back and seat loadings as described above for the first embodiment and illustrated in FIG. 4.

Figure 14:
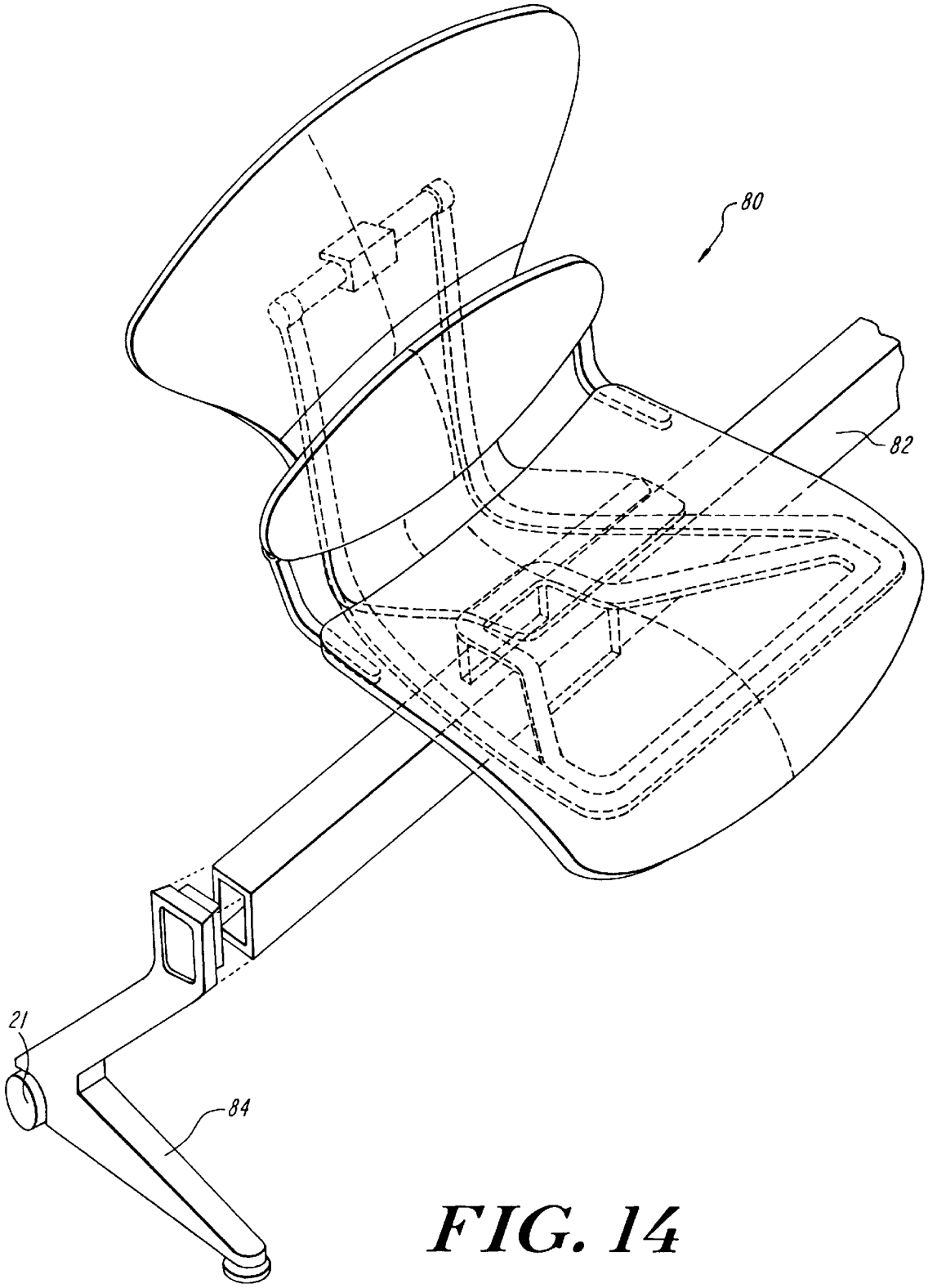
FIGS. 14–16 are views of a third embodiment of the invention together with its frame.
Figure 15:
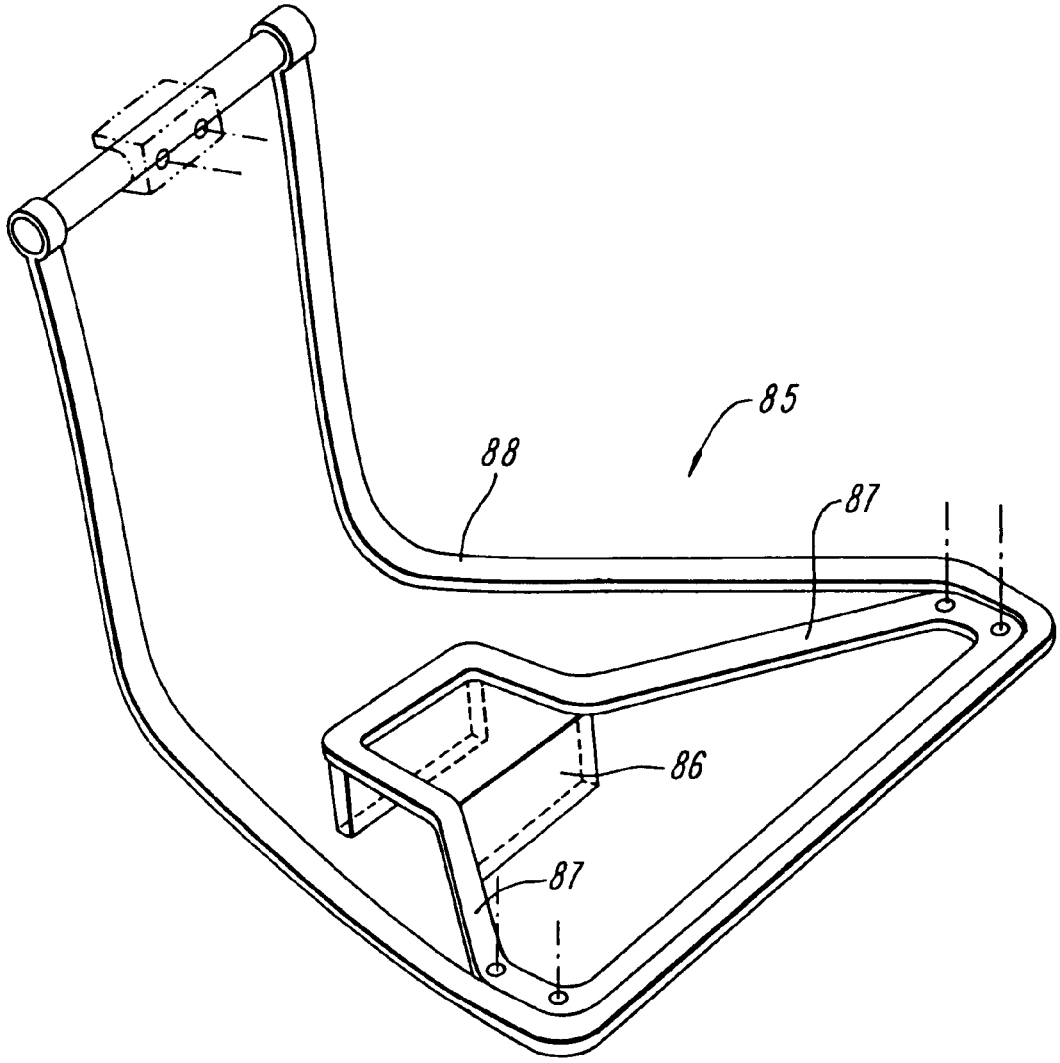
Figure 16:
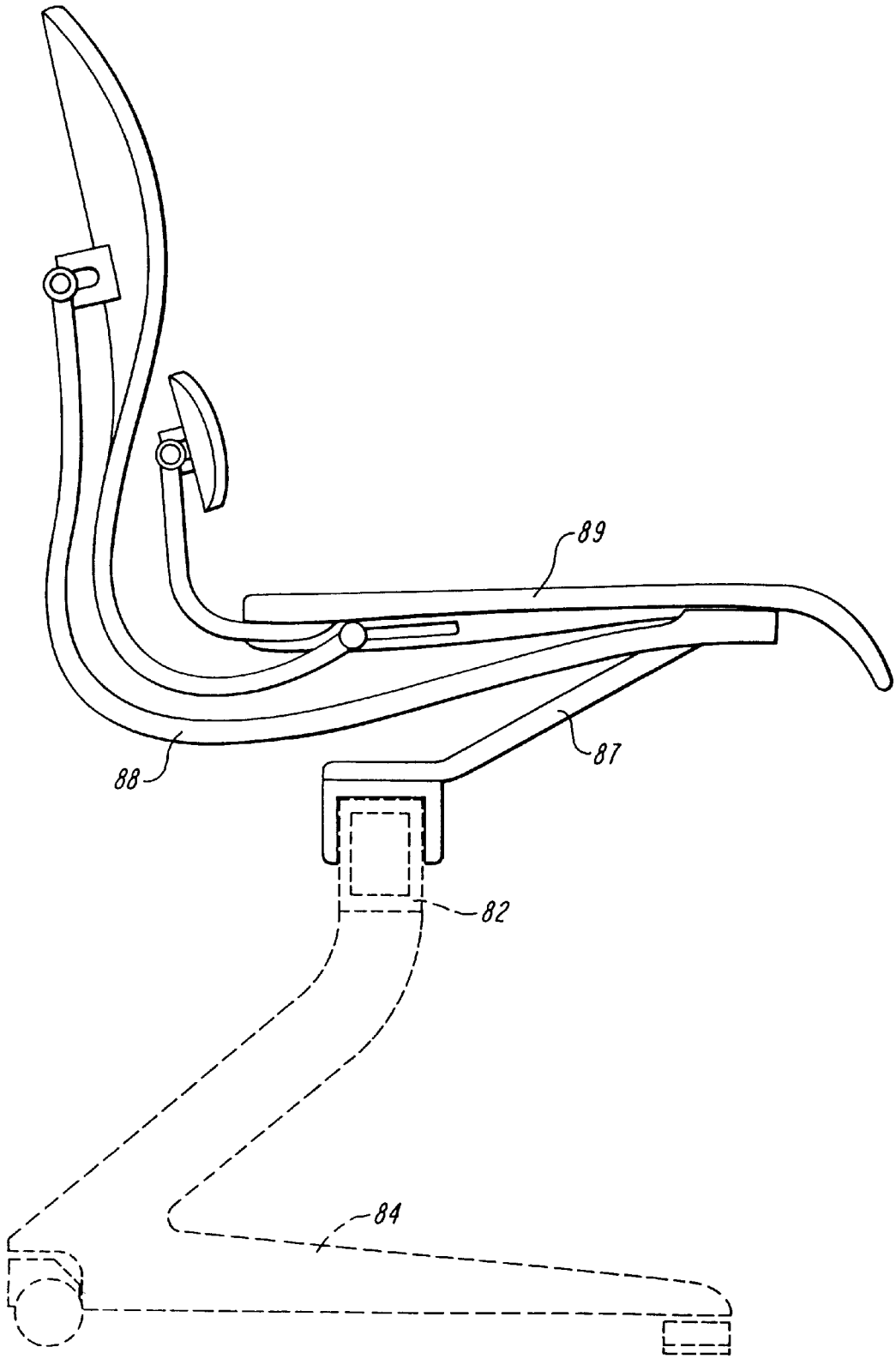

A third general embodiment 80 is illustrated in FIGS. 14–16. In this embodiment as a tandem chair, the base 40 or legs 2, 6 of the earlier embodiments are replaced by a single arrangement of one or more beams 82 and stands 84 that provide support for a plurality of seating units each affixed to the beam or beams by an abbreviated, non-adjustable skeleton frame 85 having a frame bracket 86 (FIG. 15). Frame 85 may, for example, be made of an eight or ten millimeter thick solid steel bar stock. The articulations to the seat bottom, upper back suspension, and lumbar support pivot remain substantially as shown for the two previously described embodiments. Frame 85 may, for example, carry the seat 70, back 72 and support 74 of the task chair shown in FIGS. 6–13.

One point of note in the side view, FIG. 16, is the construction of frame 85, wherein the bar members 87 extending from the frame bracket 86 join the major portion of the frame at the front edge of the seat to provide a suspension which is first cantilevered forward and up from the base, by means of frame members 87, to support the front edge of the seat, and then cantilevered back from that edge via frame members 88 to provide the pendant support upon which the upper back shell pivots. This double cantilevering of the critical suspension points for the supporting plates of the chair allows varying levels of flexural seat response to be obtained while keeping the horizontal seat shell 89, corresponding to elements 70 or 10 of the earlier embodiments, quite stiff.

Figure 17A:
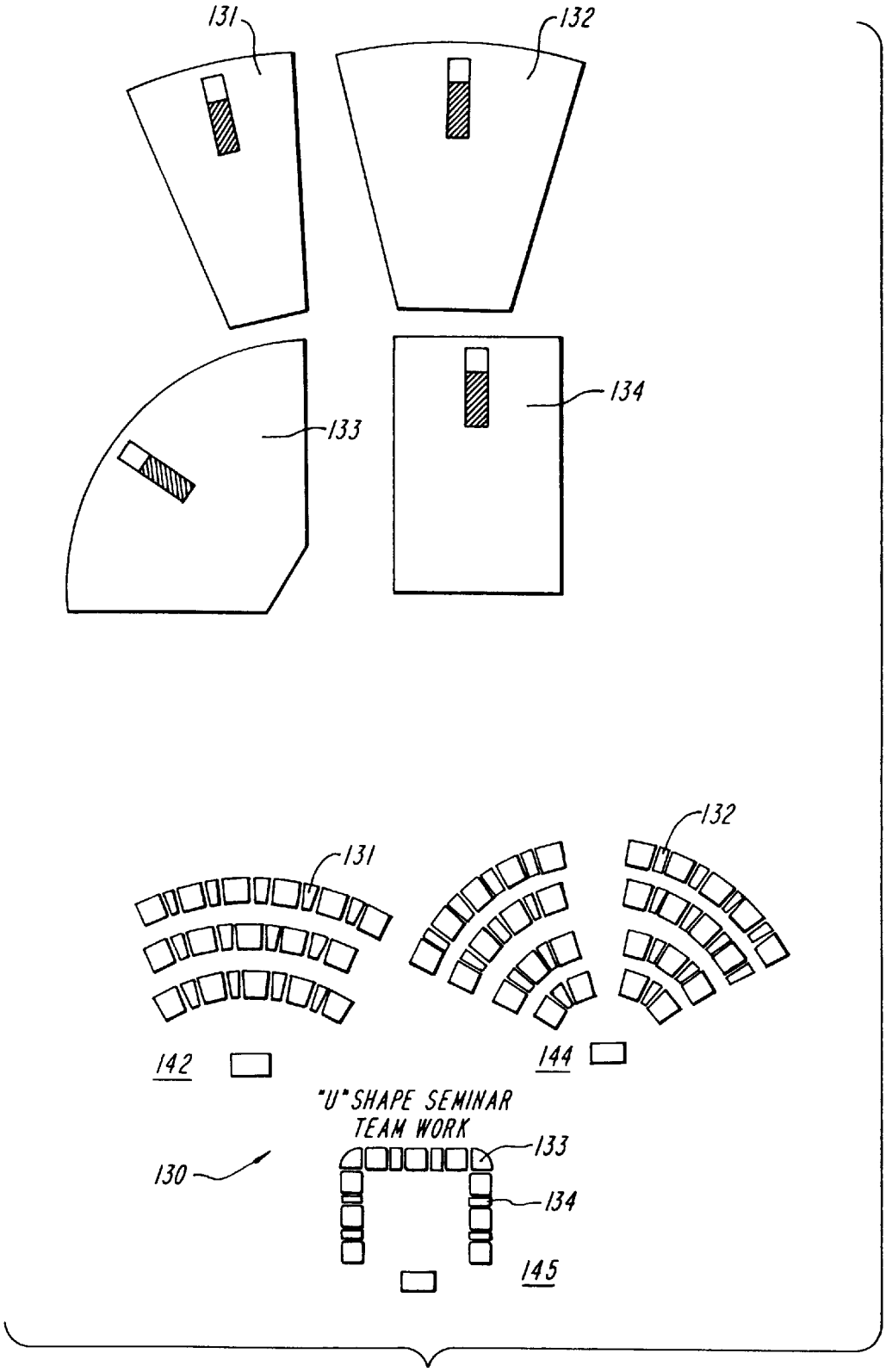
FIGS. 17A, 17B illustrate details of row mounting for the chair of FIG. 1.
Figure 17B:
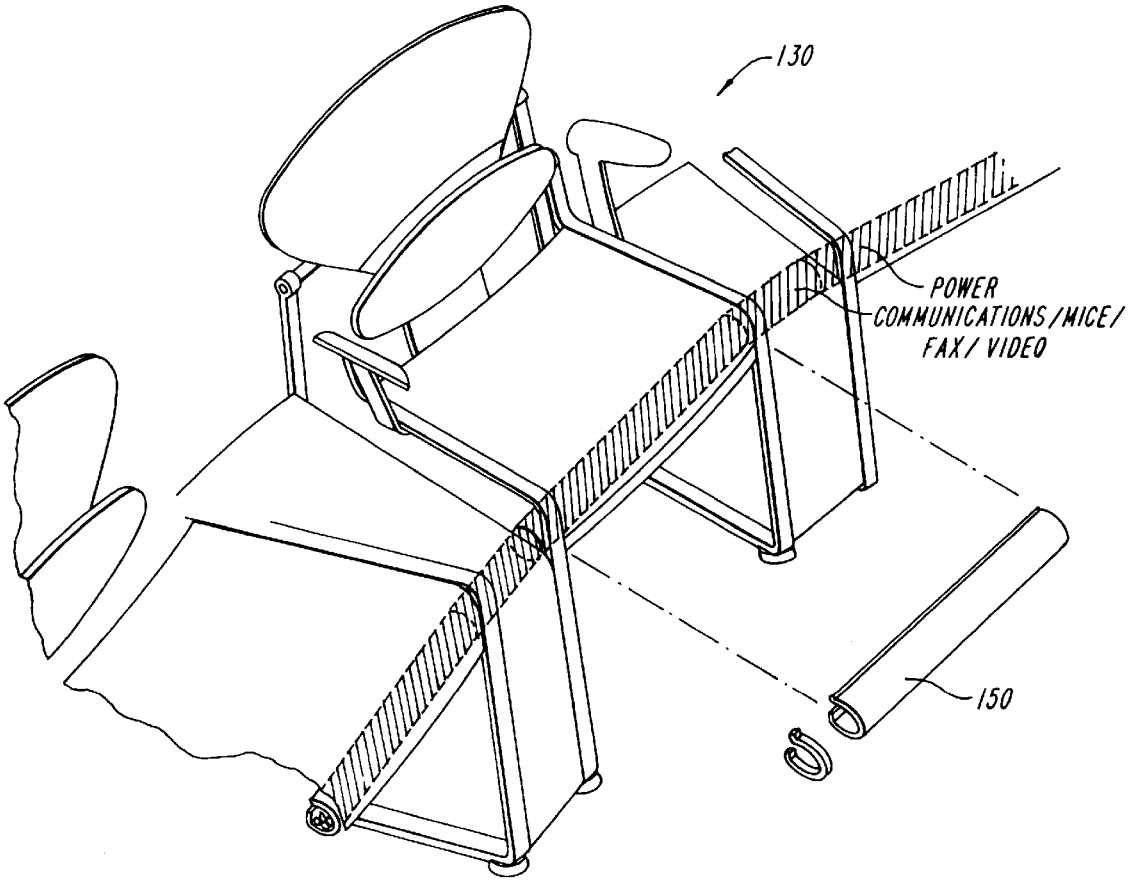

Returning briefly to FIG. 5, the wedge units 30, 30*a* provide a utility space, including both a support surface and utility or communications outlets. In a preferred system utilizing any of the above described chair embodiments, the wedges are provided in a number of predetermined angular segments and also define row and arc layouts of ranks of seats. Such a system 130 is shown in FIGS. 17A, 17B. The wedges are formed in a small number of discrete sizes, illustrated by a narrow angle wedge 131, a wide angle wedge 132, a right angle wedge 133 and a straight wedge 134. When rigidly affixed between seats, these wedges unify the separate seats into shaped rows, as indicated by the seating charts 142 (for a classroom or theater) 144 (for a theater or a seminar/conference room) and 145 (for a meeting room). In installing utility lines for rows such as these, a preferred construction shown in FIG. 17B employs separate conduits or protector sheaths 150 for wire, which extend under the chair seat between adjacent wedge units, and attach to the wedge units. A similar construction is applicable to the chairs of FIGS. 14–16, with suitable modifications to accommodate the frame of those seats.

This completes a description of the illustrated embodiments, and representative variations and subsidiary features. It will be understood, however, that alternative implementations and equivalents may be substituted for the particular structures shown, without departing from the invention described herein. For example, the hinge 18 connecting the back and seat members need not be a metal hingepin-type hinge, but may be a flexible plastic sheet attached to both members to provide the required flexure coupling. The articulation point between the back and the seat may vary in aspect or relative position. Similarly, the frames of each embodiment may take diverse forms, so long as they meet the requirements of supporting the other elements. Other variations and modifications will occur to those skilled in the art, and all such variations are intended to fall with the invention, as defined by the claims appended hereto.

What is claimed is:

1. A chair comprising a seat extending from a front to a rear, means for supporting at least the front of the seat, said means for supporting including a frame attached to said front, said frame including a leg portion extending downward to contact a floor and a rear portion extending behind the rear of the seat, a back having an upper and a lower portion, said upper portion being attached to the rear portion of the frame and said lower portion being attached under the seat, a lumbar support carried by the rear portion of the seat to move therewith, said frame flexing when weight is on the seat so that the back changes its disposition with respect to the seat and the lumbar support, wherein said frame comprises a pair of elongated members each forming respective front and back legs, said back hanging from the back legs, and said seat being supported on the front legs.

2. A chair according to claim 1, further comprising an arm rest affixed at the rear of the seat.

3. A chair according to claim 1, wherein said frame is an articulated frame which flexes at articulations.

4. A chair according to claim 1, wherein said lumbar support moves with the rear portion of said seat as weight on the seat changes the angular disposition of said seat and said back.

5. A chair according to claim 4, further comprising a pair of castors located only at rear feet thereof, the chair being configured for stacking multiple identically oriented units one on top of another in balance so that a stack of chairs is rollably supported upon the castors of a bottom chair in the stack.

6. A chair according to claim 4, further comprising arm rests rigidly affixed to the back.

7. A chair according to claim 4, wherein said lumbar support includes a cushion pad having a convex and resilient body-contacting face, and means for adjusting amount of convexity of said face.

8. A chair according to claim 4, wherein each of said seat, said back and said lumbar support is mounted for changing its angular disposition about a respective one of three axes, the three axes being substantially parallel.

9. A chair according to claim 4, further comprising a wedge, affixed to the chair, for orienting the chair in a rank.

10. A chair according to claim 9, wherein the wedge includes means for providing to the chair a utility selected from among electricity, light and communications.

11. A chair according to claim 9, wherein the wedge has a discrete angle for setting curvature of the rank.

12. A chair according to claim 4, further comprising a tablet mounted for resting in a first position adjacent the chair, and a second position across the chair.

13. A chair according to claim 12, wherein the tablet is mounted via a slide-pivot mounting to retract to a position adjacent the chair.

14. A chair according to claim 13, wherein the slide pivot mounting is rigidly attached to the seat.

15. A chair comprising:

a seat extending from a front to a rear, means for supporting at least the front of the seat, said means for supporting including a frame attached to said front and a rear portion extending behind the rear of the seat, a back having an upper and a lower portion, said upper portion being attached to the rear portion of the frame and said lower portion being attached under the seat, and a lumbar support carried by the rear of the seat to move therewith, said frame flexing when weight is on the seat so that the back changes its disposition with respect to the seat and the lumbar support, wherein said frame includes a bracket for mounting the chair on a beam, a first member cantilevered forward from the bracket, and a second member cantilevered backward from a front portion of the first member.

16. In a chair having a seat, a back and a lumbar support, the improvement comprising holding means having a pair of elongated members each forming respective front and back legs for securing said seat, said back and said lumbar support such that the back and the lumbar support move independently as weight is applied on the seat to change the angle of the back with respect to the seat while maintaining the lumbar support in a pressure-applying position.

17. An improved chair according to claim 16, wherein the holding means includes a flexible frame having front and rear portions, supporting the seat and the back, respectively, and wherein flexing of said frame changes the angle of said seat.

18. A chair comprising a support a seat attached to the support to provide a substantially horizontal sitting surface a back hingedly attached at a lower end below the seat, said support further extending above and behind the seat to a position supporting an upper portion of said back causing said back to move forward in response to weight on said seat, and a lumbar rest coupled to a rear portion of said seat for tracking motion of said seat to maintain contact in the lumbar region of a person sitting on the seat as the back changes angle with respect to said seat;

wherein said support comprises a pair of elongated members each forming respective front and back legs, said back hanging from the back legs, and said seat being supported on the front legs.

19. A chair comprising:

a seat extending from a front to a rear, means for supporting at least the front of the seat, said means for supporting including a frame attached to said front and a rear portion extending behind the rear of the seat, a back having an upper and a lower portion, said upper portion being attached to the rear portion of the frame and said lower portion being attached under the seat, and a lumbar support carried by the rear portion of the seat to move therewith, said frame flexing when weight is on the seat so that the back changes its disposition with respect to the seat and the lumbar support, wherein said frame includes a movable base, and an upper frame supported by said base, wherein said upper frame is adjustably positioned with respect to said base to vary the angle and the height of said upper frame.

* * * * *